US007448448B2

(12) United States Patent
Lovell et al.

(10) Patent No.: US 7,448,448 B2
(45) Date of Patent: Nov. 11, 2008

(54) SYSTEM AND METHOD FOR TREATMENT OF A WELL

(75) Inventors: John R. Lovell, Houston, TX (US); Teoman Altinkopru, Abu Dhabi (AE); Robert Bucher, Houston, TX (US); Shunfeng Zheng, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 232 days.

(21) Appl. No.: 11/305,489

(22) Filed: Dec. 15, 2005

(65) Prior Publication Data

US 2007/0137860 A1 Jun. 21, 2007

(51) Int. Cl.
*E21B 43/16* (2006.01)
*E21B 47/00* (2006.01)

(52) U.S. Cl. ..... 166/279; 166/250.01; 166/305.1; 166/310; 507/200

(58) Field of Classification Search ..... 166/263, 166/300, 305.1, 400, 310, 279, 250.01; 507/200, 507/928

See application file for complete search history.

(56) References Cited

U.S. PATENT DOCUMENTS 3,250,330 A * 5/1966 Smith, Jr. ..... 166/295
6,268,911 B1 7/2001 Tubel et al.
6,588,266 B2 7/2003 Tubel et al.
2001/0020675 A1 9/2001 Tubel et al.
2001/0023614 A1 9/2001 Tubel et al.
2002/0066309 A1 6/2002 Tubel et al.
2003/0205083 A1 11/2003 Tubel et al.
2005/0178551 A1 8/2005 Tolman
2005/0263281 A1 12/2005 Lovell et al.
2007/0095528 A1 * 5/2007 Ziauddin et al. ..... 166/252.3

FOREIGN PATENT DOCUMENTS

WO 9850680 A2 11/1998
WO 0043633 7/2000
WO 2005033465 A2 4/2005
WO 2005116388 A1 12/2005
WO 2004018840 6/2007

* cited by examiner

*Primary Examiner*—Kenneth Thompson
(74) *Attorney, Agent, or Firm*—Rodney Warfford; David Cate; Robin Nava

(57) ABSTRACT

A fluid injection system is used in a well. Fluid stages are arranged in repeating series within a tubing of the fluid injection system to facilitate control over effects of injection. A sensor system can be used to detect one or more parameters related to the fluids moved downhole through the tubing to further enhance injection procedures.

17 Claims, 8 Drawing Sheets

SYSTEM AND METHOD FOR TREATMENT OF A WELL

BACKGROUND

The invention generally relates to a system and method for facilitating the treatment of wells. For example, a well treatment may comprise the stimulation of an oilfield reservoir by injecting fluids into the reservoir. A variety of other well treatments also involve the flowing of fluids downhole.

In treating wells, a treatment fluid is routed downhole through a tubing and then expelled to the formation through a bottom hole assembly. However, a latency often exists between changes made by an operator at the surface and corresponding changes occurring downhole, particularly when those changes relate to changes in the fluids pumped through the tubing. Because the tubing is already full of fluid, any new fluid must be added above the column of fluid already existing in the tubing. For example, if sensors indicate a need for additional pre-flush acid before injection of stimulation acid, there is no convenient action that can be taken because the tubing has already been filled with the desired amount of well stimulation acid disposed above the pre-flush acid.

Additionally, the extreme length of the tubing in some applications creates substantial time delay between entrance of the fluid into the tubing at a surface location and exit of the fluid downhole. This substantial distance and time delay can create difficulties for the well operator in determining flow characteristics of the fluid or fluids as the fluid or fluids flow downhole and into the wellbore.

SUMMARY

The present invention comprises a system and method used for optimization of well treatments. A series of staged fluids can be disposed within a tubing, such as coiled tubing, which is deployed in a wellbore. In at least some applications, a sensor system is used to detect one or more parameters related to the fluids moved downhole through the tubing. The technique facilitates improved control over the inflow of fluids into the well and optimization of the well treatment, both in amount and placement of fluid.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The present invention relates to a system and methodology for optimizing treatment of a well. In one aspect, the latency effects of fluids pumped downhole are reduced by stacking or layering relatively small amounts of different fluids in sub-treatments or series within a tubing used to deliver the fluids to a desired location in a well. One or more series of fluid stages are selected for injection into a surrounding formation. After injecting the series of fluids, real-time data can be used through modeling for analysis to determine whether another series, e.g. a different series of fluids, is needed. This process can be repeated until adequate treatment of the well is completed. According to another aspect of the invention, well parameters, such as flow related data, are collected from one or more sensor locations in real time, and that data is used in modeling fluid flow to better enable optimization of the well treatment.

Figure 1:
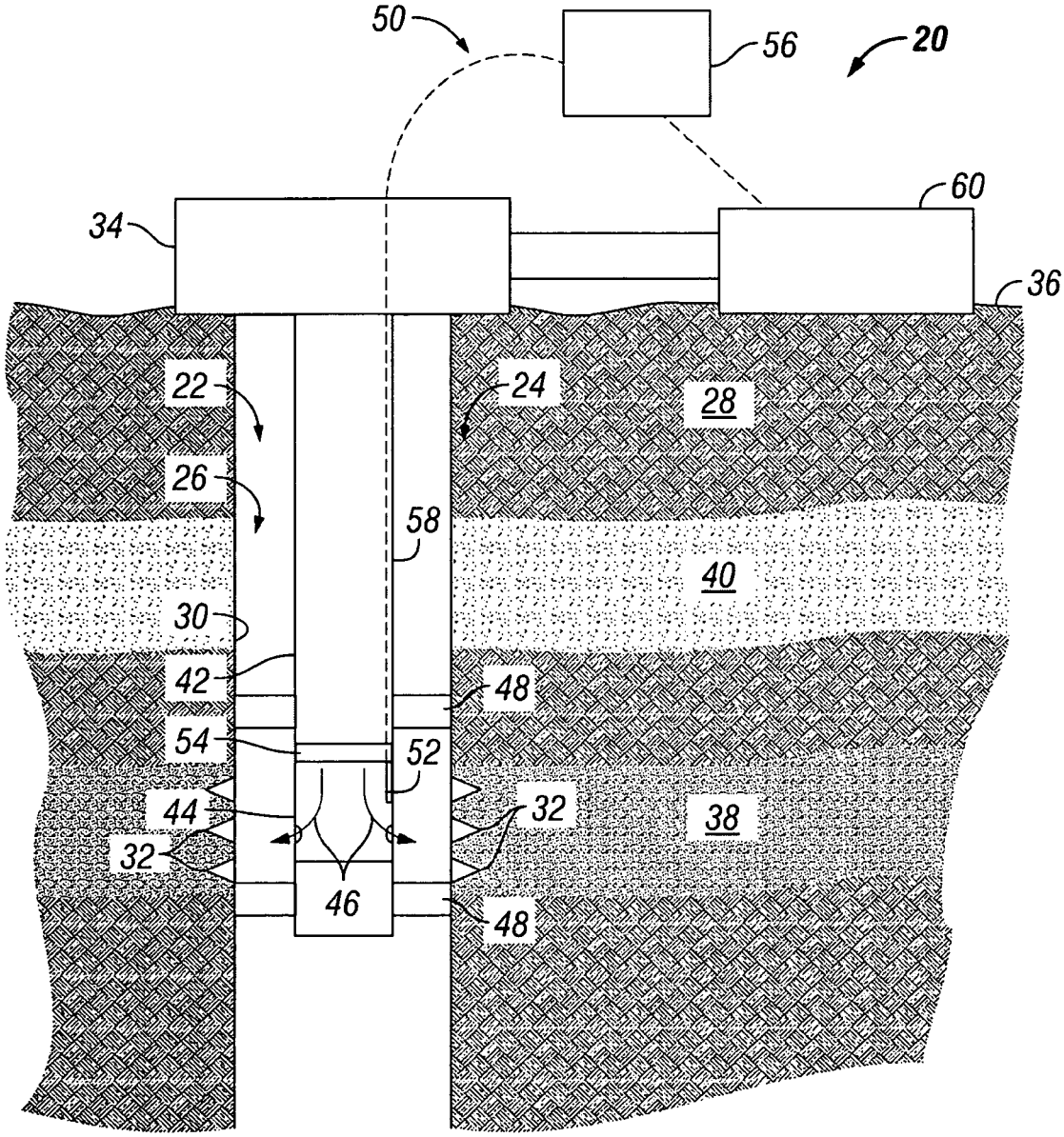
FIG. 1 is a front elevation view of a fluid injection system deployed in a wellbore, according to one embodiment of the present invention.

Referring generally to FIG. 1, a well system 20 is illustrated according to one embodiment of the present invention. The well system 20 comprises, for example, a well completion 22 deployed for use in a well 24 having a wellbore 26 drilled into a reservoir 28 containing desirable fluids, such as hydrocarbon based fluids. In many applications, wellbore 26 is lined with a wellbore casing 30 having perforations 32 through which fluids can flow between wellbore 26 and the reservoir 28. Completion 22 is deployed in wellbore 26 below a wellhead 34 which is disposed at a surface location 36, such as the surface of the Earth or a seabed floor. Wellbore 26 may be formed in regions that have one or more formations of interest, such as formations 38 and 40.

Completion 22 is located within the interior of casing 30 and comprises a tubing 42 and a plurality of completion components, such as a bottom hole assembly 44 through which fluids can be injected from tubing 42 into wellbore 26 and the surrounding formation, as indicated by arrows 46. In this embodiment, well completion 22 also may comprise one or more packers 48 which can be set between tubing 42 and the surrounding casing 30 to isolate specific well zones for injection of fluid.

Various well parameters, such as a fluid flow parameters, can be detected by a sensor system 50 having one or more sensors 52 positioned at selected locations of well system 20. In the example illustrated, sensors 52 are deployed downhole, and data from the sensors is transmitted by a transmitting device 54 to a control system 56. Control system 56 may comprise a surface data acquisition system to receive and demodulate the transmitted data for use in, for example, a software interpretation product run on control system 56. The data can be transmitted via a communication line 58, such as a fiber optic line, wireline cable or other transmission line. Additionally, data signals can be transmitted wirelessly by device 54 via, for example, pressure pulses through the fluid or modulated electromagnetic waves sent upwards through the rock of reservoir 28. Sensors 52 can be used to detect a variety of well parameters that can be used to evaluate, for example, fluid flow and/or well conditions. Examples of parameters detected by sensors 52 include pressure, flow, temperature, resistivity and fluid density.

As discussed above, embodiments of the present invention are directed to injecting one or more series of fluid stages into the formation. Accordingly, control system 56 may include a visualization system to assist the user in identifying which fluid is exiting the tubing 42 at any given time, as well as advisor software, to recommend pump rates and rates at which the tubing 42 is moved. For example, in many applications it may be important to coordinate the motion of the tubing 42 along with the rate at which the fluid is pumped, so that a certain fluid stage reaches the end of the tubing not just at a specific time, but also at a specific location within the wellbore 26. This advisor software accounts for the fact that some of the fluid stages may be compressible, in which case the volume they take up within the tubing 42 varies with pressure. Downhole sensors 52 can convey the bottom hole data needed to perform this calculation. In addition to needing to estimate pressure along the tubing 42, the advisor software can account for the friction of the fluid stage as it passes along the tubing 42. This is often very difficult to determine in real-time because it can vary with the history of the use of the tubing 42 (what fluids were pumped before the job, how smooth is the interior of the tubing, etc). Consequently additional measurements may be required to determine which particular stage of fluid is exiting the tubing 42 at any given time. That information transmitted back to the advisor software can then be used to aid in the forecast of the arrival of subsequent stages to the end of the tubing.

Figure 10A:
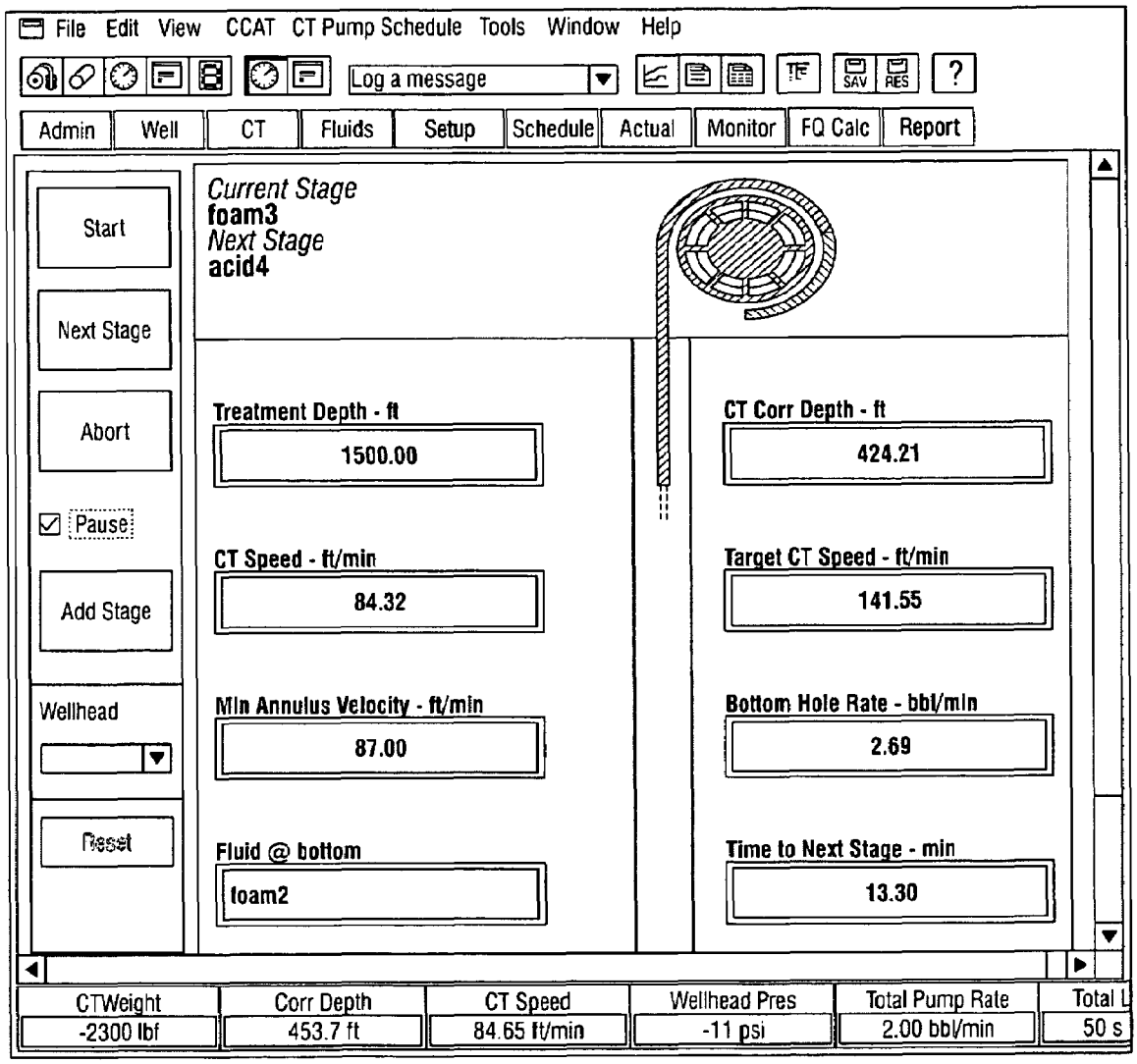
FIGS. 10A and 10B illustrate an embodiment of the visualization system of the present invention.
Figure 10B:
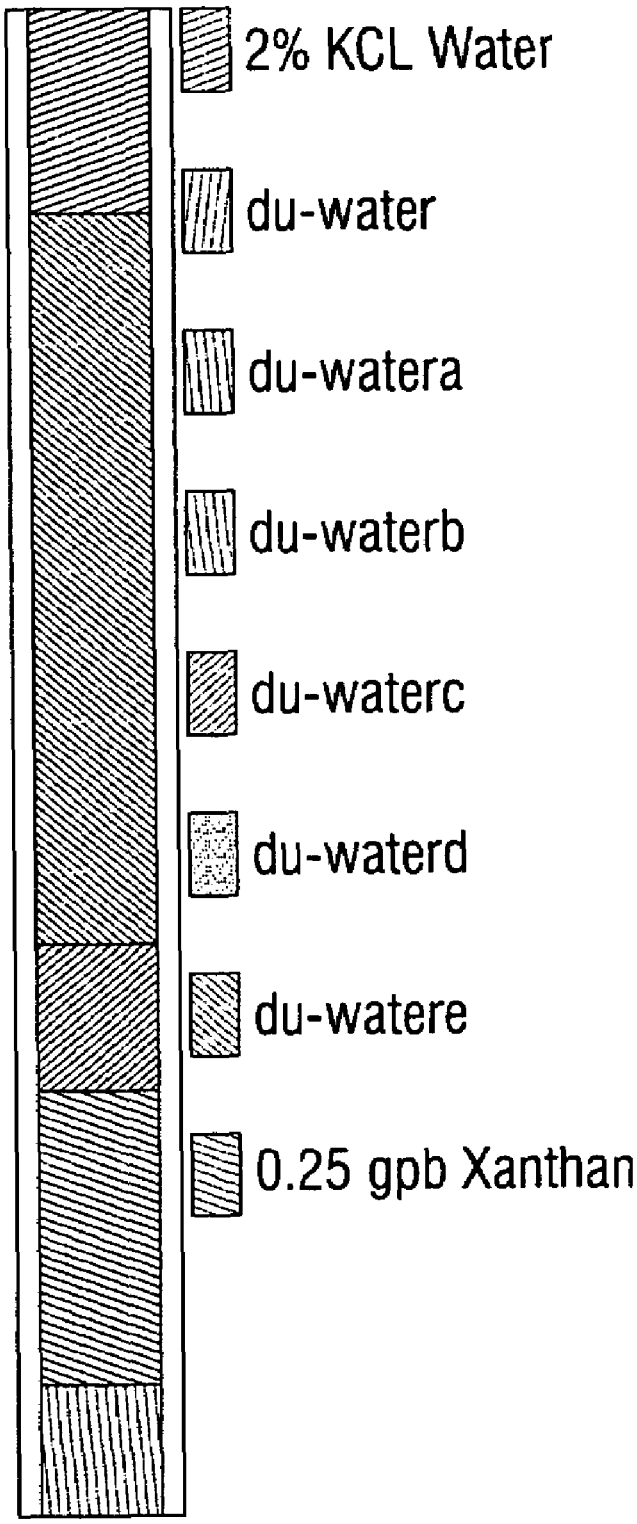

FIGS. 10A and 10B show the output provided by an embodiment of the visualization system of the present invention. As shown in FIG. 10A, the time and depth at which each fluid is going to exit the tubing is provided. As shown in FIG. 10B, each stage is illustrated by different colors or shades.

In many applications, tubing 42 comprises coiled tubing deployed into wellbore 26 by a coiled tubing rig. Additionally, a fluid control system 60 is used to control the specific stages of fluids deployed into the coiled tubing 42. Fluid control system 60 can be a manual system run by an operator connecting appropriate hoses to dispense the desired fluids into tubing 42. However, the control system 60 also can be an automated system, such as a computer controlled system, that controls valving for dispensing the desired fluids into tubing 42 in a desired order, desired rate and in the desired amounts. For example, fluid control system 60 can be controlled by computer control system 56.

For each target treatment formation, the fluids may be loaded in sequence into the coiled tubing with an adequate amount of each stage, e.g. a pre-flush acid, a stimulation acid and a post-flush acid. Alternatively, the fluids may be loaded into tubing 42 in relatively small amounts in a specific order to carry out the desired well treatment, e.g. a reservoir stimulation. For example, instead of loading the coiled tubing 42 with the entire amount of pre-flush acid, followed by the entire amount of stimulation acid, followed by the entire amount of post-flush acid, the coiled tubing 42 may be loaded with consecutive series of the treatment fluids in much smaller amounts. This enables adjustment of the well treatment based on sensed parameters. If the sensors indicate a need for further treatment, additional series of the layered fluids can be injected as required to optimize the specific well treatment.

Figure 2:
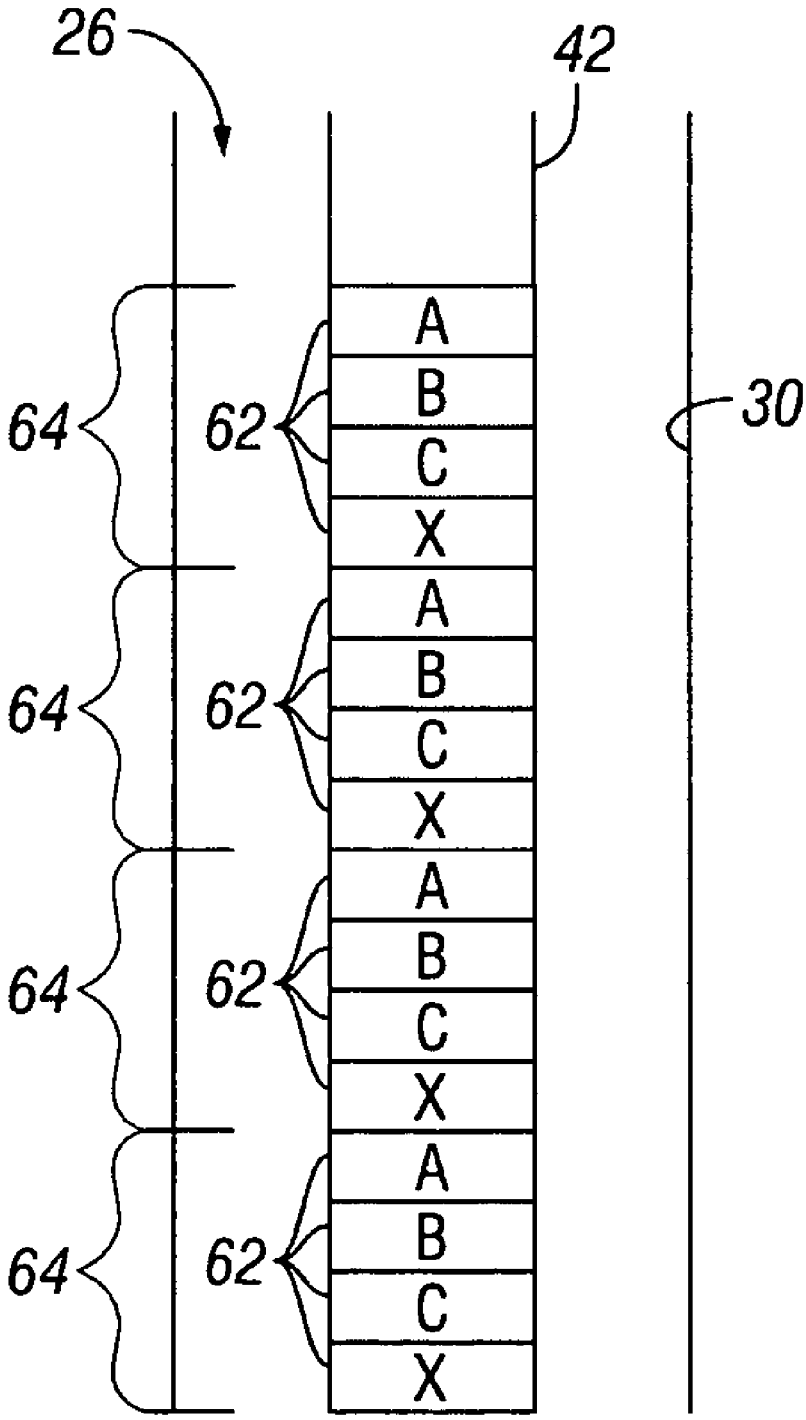
FIG. 2 is a schematic illustration of a series of fluid stages within a tubing, according to an embodiment of the present invention.

As illustrated in FIG. 2, fluids are loaded into coiled tubing 42 in stages 62 that are arranged in one or more series 64. In this example, each series may comprise a plurality of fluids A, B, C and X that are stacked in consecutive, e.g. repeating, fashion along tubing 42, however the types of fluids, sequence of fluids, and the volumes of fluids can vary from one series to another. Or, a series may comprise a single fluid. Depending on the specific well treatment and the specific fluids, the well treatment may comprise initially injecting a predetermined number of series 64. The injection flow is then discontinued while data is gathered by sensors 52. Based on this information, additional series 64 may be injected or the treatment of the formation may be concluded. In the embodiment of FIG. 1, for example, the treatment of formation 38 may be concluded, and bottom hole assembly 44 may be moved by coiled tubing 42 to a next formation, such as formation 40. If one or more packers 48 are being used for isolation, they can be reset for injection of one or more series 64 of staged fluids 62 into formation 40. The ratio of fluid volumes of one stage 62 relative to another is pre-determined based on conventional analysis of the rock properties for a given formation. Additionally, the amount of fluid in each stage can be affected by knowledge of the completion equipment deployed downhole. For example, if the environment and equipment is susceptible to scale, an extra amount of scale removal fluid can be dispensed in a given stage.

The number of fluid stages 62 in each series 64 and the types of fluids used depends on the specific well treatment conducted. By way of example only, each series 64 may be designed for a well stimulation treatment and comprise a pre-flush acid (e.g. HCL in stage C), a stimulation acid (e.g. HF/HCL mix in stage B), a post-flush acid (e.g. HCL in stage A) and a spacer fluid (e.g. foam or brine in stage X). The spacer fluid generally does not affect the treatment operation but provides a "clean" interruption stage for stopping flow while well parameters are detected to determine whether additional series 64 are to be injected. The sensor system 50 also can be used to detect when fluid flowing through bottom hole assembly 44 is a spacer stage, thus providing an indication to the well operator of an opportune time to temporarily suspend the injection process. In some applications, fluid flow from the formation can be allowed at this time to facilitate detection of well related parameters by sensors 52, e.g. distribution of temperature along the wellbore. The sensor data aids in determining whether injection of additional series 64 is desired to optimize results of the well treatment. Upon receiving indication of optimal stimulation, the coiled tubing 42 can be pulled to another zone for repetition of the treatment.

Figure 3:
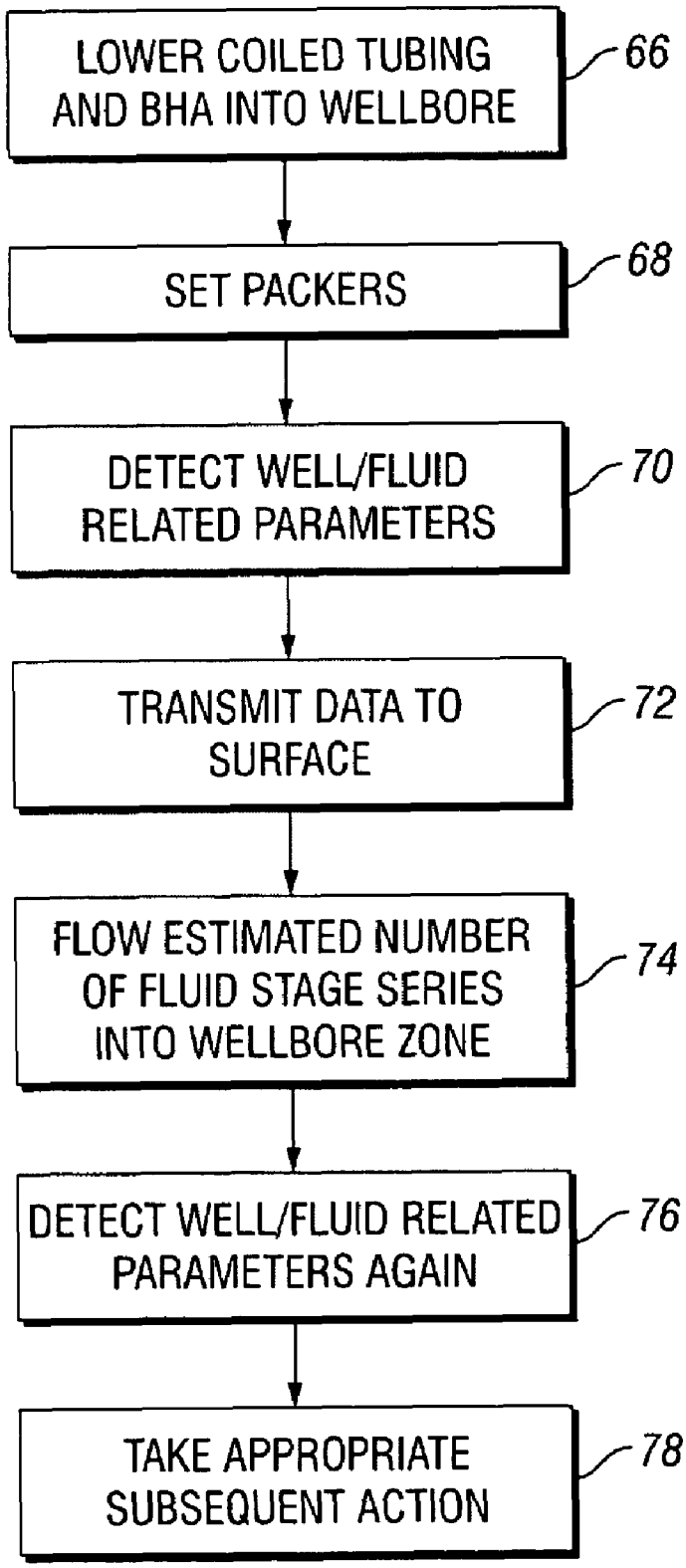
FIG. 3 is a flowchart illustrating one well treatment methodology, according to an embodiment of the present invention.

An example of the treatment methodology is described with reference to the flowchart of FIG. 3. As illustrated, the coiled tubing 42 and bottom hole assembly 44 initially are lowered into wellbore 26, as indicated by block 66. The bottom hole assembly is positioned at a desired location within the wellbore, e.g. proximate formation 38. If necessary, zonal isolation within the wellbore is then established by inflating or otherwise setting one or more packers 48, as indicated by block 68. Sensor system 50 can be used to detect well related parameters used in determining a desired well treatment process, as indicated by block 70. The data from sensors 52 is transmitted to a surface location, such as to control system 56, for analysis in estimating the number of series 64 needed to achieve an optimal well treatment, e.g. well stimulation, as indicated by block 72. In this example, the data is collected and transmitted on a real-time basis. Based on this analysis, the estimated number of series 64 of fluid stages 62 is flowed through bottom hole assembly 44, into wellbore 26 between packers 48, and into formation 38, as indicated by block 74. It should be noted that in some applications, e.g. wellbore clean out applications or drilling applications, at least a portion of the fluid flows upwardly through the annulus surrounding tubing 42. Characteristics of the fluid flowing upwardly through the annulus can be used to determine whether optimal flow is being achieved during the procedure. In fact, sensor system 50 can be used to detect a variety of flow related characteristics both within tubing 42 and external of tubing 42, as explained more fully below.

Following injection of the estimated number of series of fluid stages into the desired wellbore zone, sensors 52 can again be used to detect well related parameters indicative of whether the well treatment process has been optimized, as indicated by block 76. Well related parameters can be measured by stopping injection of fluid stages 62 at a spacer stage X to enable flow from the surrounding formation 38. However, other well parameters can be measured during flow of the fluid stages. The data obtained is again transmitted to control system 56 for analysis to determine the appropriate subsequent action, as indicated by block 78. The appropriate subsequent action can include, for example, injection of a single additional series 64 or further injection of a plurality of series 64 or simply increasing the pump rate. If the one or more packers 48 are not used in the bottom hole assembly, or if the one or more packers 48 are not set, the appropriate action may further include varying the velocity (speed and running direction) of coiled tubing 42. Alternately, the procedure can be concluded at that wellbore location, and bottom hole assembly 44 can be moved to the next formation, e.g. formation 40, for repetition of the treatment procedure. If the one or more packers 48 are used in the bottom hole assembly, movement of bottom hole assembly 44 may involve releasing the packer or packers 48 and lifting bottom hole assembly 44 via coiled tubing 42 to the desired location. However, other applications may not require packers 48. Upon completion of the injection procedures at all desired wellbore locations, system 22 can be removed from wellbore 26.

Figure 4:
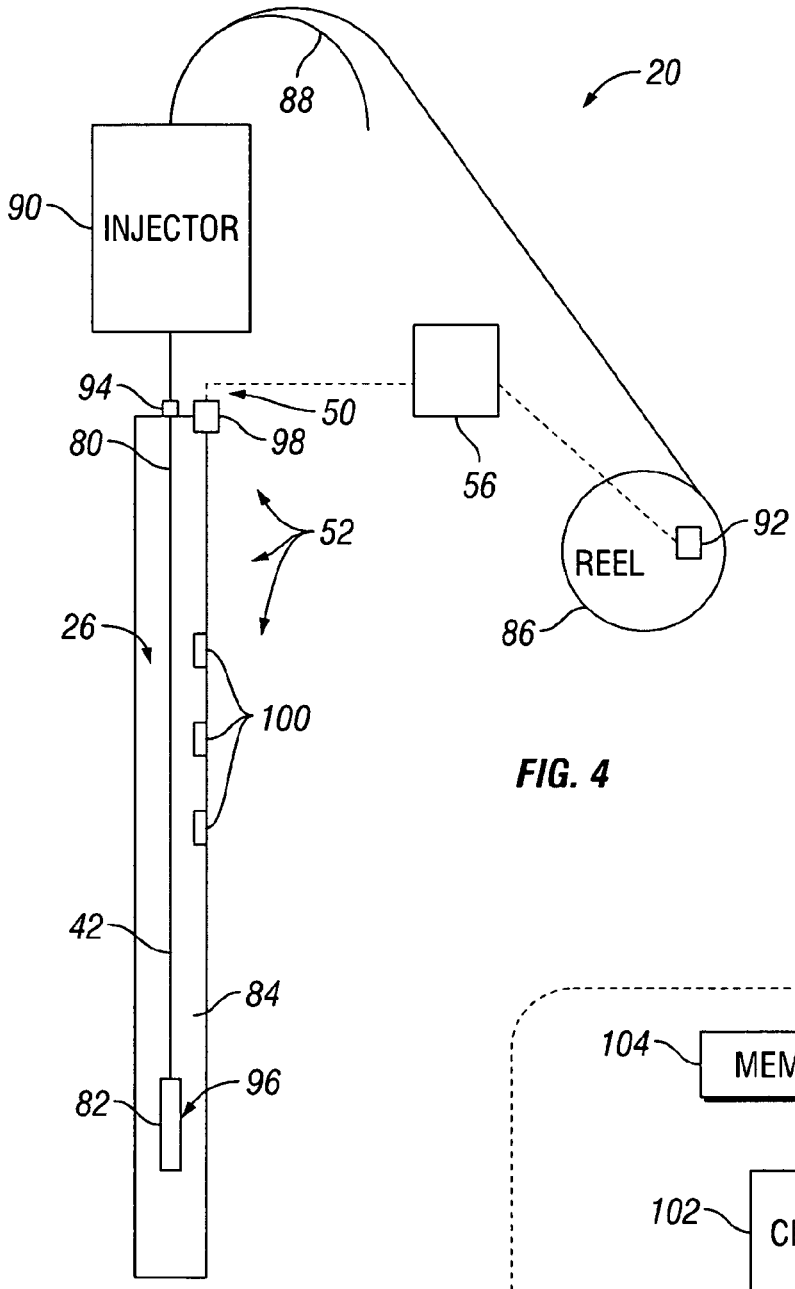
FIG. 4 is an elevation view of a fluid injection system deployed in a wellbore, including a sensor system, according to another embodiment of the present invention.

Referring generally to FIG. 4, an alternate embodiment of system 20 is illustrated. In this embodiment, coiled tubing 42 again is used as a fluid conduit to deliver treating fluids to the surrounding formation. Often, the treatment fluids are staged with different fluids layered on top of each other within tubing 42. In some applications, the extreme length of coiled tubing 42 causes a substantial time delay in pumping a given fluid from a surface end 80 of coiled tubing 42 to a downhole or exit end 82. Real time evaluation of the treatment can be enhanced by tracking the movement of the staged fluids inside coiled tubing 42 from, for example, the time at which fluid is pumped into the coiled tubing to the time it exits the coiled tubing at downhole end 82.

In certain applications, e.g. wellbore cleaning applications, additional types of treating fluids can be pumped through coiled tubing 42. For example, a first type of fluid can be used for circulation purposes, while other types of fluids can be pumped downhole for cleaning purposes to remove different types of sand, scale or other contaminants. In such procedures, at least some of the fluid is returned upwardly through an annulus 84 surrounding tubing 42. Efficiency of the treatment procedure is improved by real time tracking of well parameters, such as parameters related to movement of fluids down through coiled tubing 42 and/or up through annulus 84. Efficiency of the treatment can also be improved by coordinating the movement of coiled tubing 42 and the flow of stage fluids 62 such that the desired fluids exit coiled tubing 42 at the desired well depth interval. A variety of other well applications also can benefit from real time tracking of staged fluids, including reservoir stimulation, hydraulic fracturing, coiled tubing drilling and other procedures involving the injected flow of fluids.

As further illustrated in FIG. 4, coiled tubing 42 may be unspooled from a reel 86 over a gooseneck 88 and into wellbore 26 via an injector 90. The movement of coiled tubing 42 into or out of wellbore 26 can be tracked by a coiled tubing sensor 92. Additionally, other sensors 52 can be deployed to detect a variety of selected well related parameters and to provide data for use in a well simulation model. By way of example, sensors 52 may comprise surface sensors 94 installed proximate surface end 80 of coiled tubing 42. Additionally, sensors 52 may comprise downhole sensors 96 positioned proximate downhole end 82 of coiled tubing 42. Depending on the application, sensors 52 also may comprise wellhead sensors 98 and/or distributed sensors 100, such as distributed temperature sensors deployed along wellbore 26. The sensors 52 output data to a surface data acquisition system which can be incorporated into control system 56 for use in modeling fluid flow for a given procedure. Also, some of the data can be used in calibrating the model to improve the well operator's ability to optimize injection of fluid for a given procedure.

Figure 5:
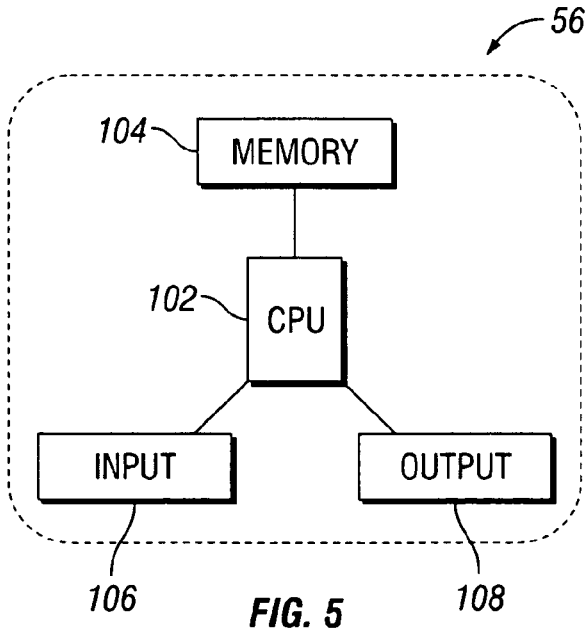
FIG. 5 is a schematic illustration of a processor based system for carrying out the injection methodology, according to an embodiment of the present invention.

Control system 56 may be a processor based control system able to process data received from the various sensors for use in both displaying relevant information to a well operator and modeling fluid flow or other well characteristics. As illustrated in FIG. 5, control system 56 may be a computer-based system having a central processing unit (CPU) 102. CPU 102 is operatively coupled to a memory 104, as well as an input device 106 and an output device 108. Input device 106 may comprise a variety of devices, such as a keyboard, mouse, voice-recognition unit, touchscreen, other input devices, or combinations of such devices. Output device 108 may comprise a visual and/or audio output device, such as a monitor having a graphical user interface. Additionally, the processing may be done on a single device or multiple devices at the well location, away from the well location, or with some devices located at the well and other devices located remotely.

The use of sensor system 50 and control system 56 enables a real-time fluid tracking and automated treatment integration such that information related to fluid within coiled tubing 42 and/or within annulus 84 can be used for optimization of the well treatment. The real-time data is obtained from sensors 52 and utilized in a simulation model for predicting characteristics of the actual well treatment. Additionally, sensors located downhole can be used to calibrate and/or provide real-time updating of the well treatment modeling to further optimize the treatment procedure.

Figure 6:
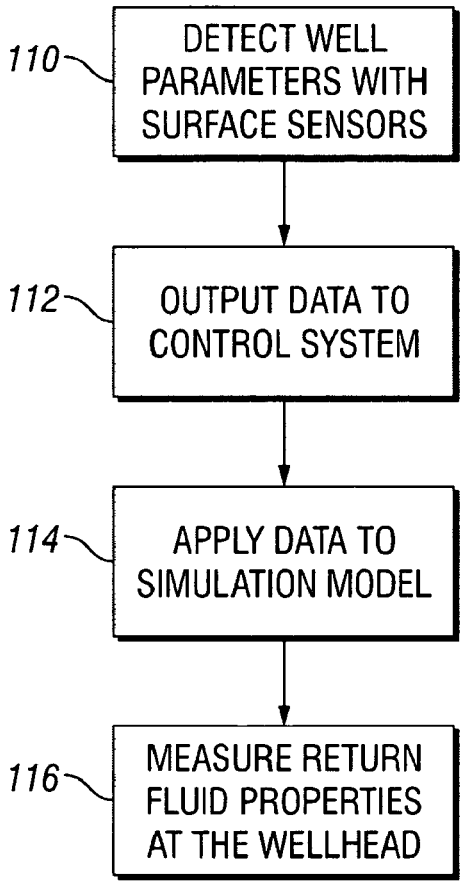
FIG. 6 is a flowchart illustrating a methodology for optimizing fluid flow, according to an embodiment of the present invention.

Referring generally to the flowchart of FIG. 6, an embodiment of a basic method for fluid tracking is illustrated. In this embodiment, a plurality of surface sensors 94 are installed at surface end 80 of coiled tubing 42 to measure fluid, e.g. liquid or gas, parameters as the fluids are pumped into coiled tubing 42, as illustrated by block 110. The surface sensors 94 are used to detect specific well parameters in real-time. The data from sensors 94 is output to the surface data acquisition system of control system 56, as illustrated by block 112. The data corresponds to well parameters, such as flow rate, pumping pressure, density and/or in situ temperature for the fluid pumped into coiled tubing 42. With knowledge of the fluid rheology and coiled tubing data, the data collected from sensors 94 can be used in a simulation model, as illustrated by block 114. A variety of software models are known and used by those of ordinary skill in the industry for fluid dynamic modeling of the flow of specific fluids through known types of tubing.

The simulation modeling can be used, for example, to calculate fluid pressure and track fluid interfaces inside the coiled tubing as the fluids travel downward and exit the coiled tubing. The same simulation model also can be used to simulate the upward flow of fluid through the annulus before exiting the wellbore at wellhead 34. Optionally, sensors 98 can be installed at the wellhead to measure return fluid properties, such as flow rate, pressure, temperature, density and sand concentration, as illustrated by block 116. By comparing the amount of fluid pumped into coiled tubing 42 with the amount of fluid returned to the wellhead, an estimation can be made of the amount of fluid entering the surrounding formation or the amount of fluid entering the wellbore from the formation. This data can be incorporated into the simulation model to enhance the prediction of fluid movement through the wellbore annulus. Use of the simulation model and its prediction of well parameters downhole enables adjustments to be made with respect to the input of fluid into tubing 42, thereby optimizing the effects of the well treatment. Also, a variety of the well parameters and modeling predictions can be presented on output device 108, e.g. through a graphical user interface, for viewing and analysis by a well operator.

Figure 7:
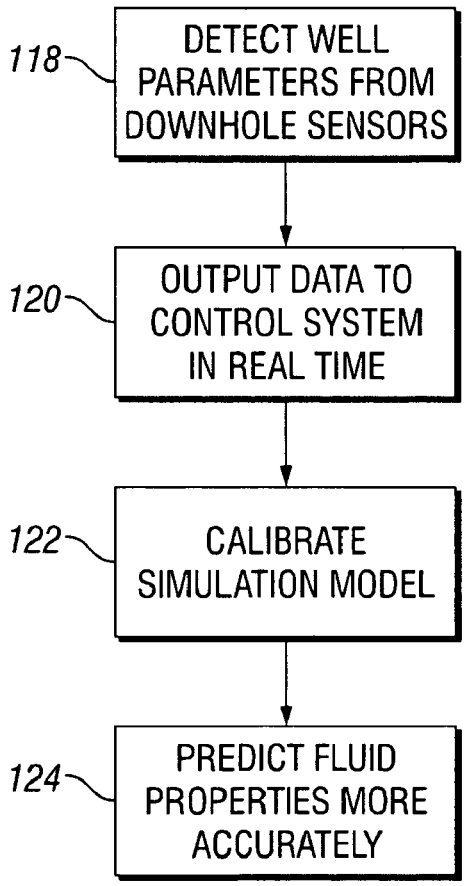
FIG. 7 is a flowchart illustrating a methodology for optimizing fluid flow, according to an embodiment of the present invention.

Additionally, downhole sensors 96 can be used to better calibrate a given simulation model and its predictive capabilities. As illustrated in the flowchart of FIG. 7, downhole sensors 96 can be positioned at downhole end 82 of coiled tubing 42 to measure fluid properties, e.g. pressure, temperature, flow rate, and the existence or arrival of specific fluid stages. (See block 118). Sensors 96 also may comprise density sensors, hydrocarbon detection sensors and solids detection sensors positioned on, for example, bottom hole assembly 44. Data collected from these sensors is transmitted back to control system 56 in real-time by an appropriate telemetry system, such as a wireless telemetry system or through a communication line, e.g. communication line 58, as illustrated by block 120. By using the measurements collected from downhole sensors 96, the simulation model can be calibrated and/or updated in real time to achieve more accurate prediction of downhole well parameters, e.g. fluid friction pressure loss, as illustrated by block 122. For example, if the pressure estimated by the simulation model at the downhole end of coiled tubing 42 is different from that actually measured by downhole sensors 96, the simulation model can be calibrated to eliminate the error and to yield a more accurate prediction, as illustrated by block 124.

Figure 8:
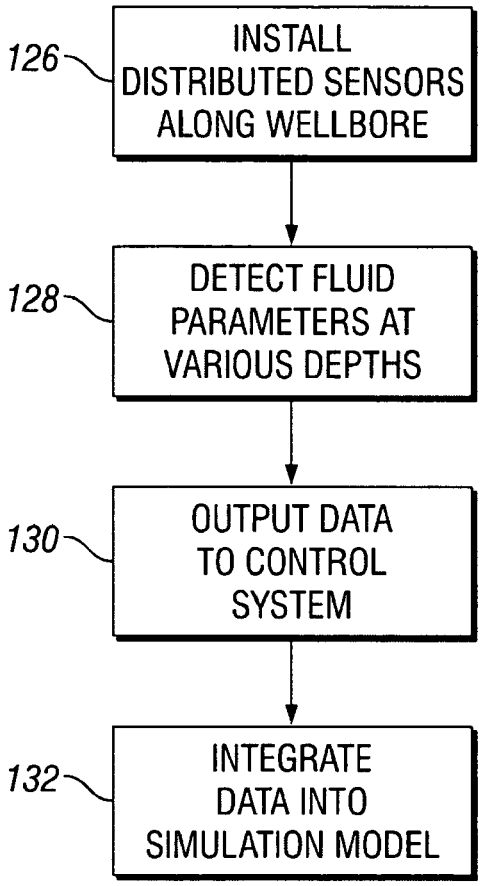
FIG. 8 is a flowchart illustrating a methodology for optimizing fluid flow, according to an embodiment of the present invention.

Another embodiment utilizes the addition of distributed sensors 100, e.g. distributed temperature sensors, deployed along the wellbore. As illustrated in the flowchart of FIG. 8, a distributed sensor system having distributed sensors 100 is initially deployed along the wellbore 26, as indicated by block 126. The distributed sensors may comprise a fiber-optic sensor system deployed, for example, along the wellbore casing or the exterior of tubing 42. The distributed sensors 100 enable the detection of fluid parameters at various depth locations along the wellbore, as indicated by block 128. Examples of measured fluid parameters include pressure, temperature, and flow rate. The various data from different depths along the wellbore is transmitted to control system 56, as indicated by block 130. Within control system 56, the data is integrated into the fluid simulation model to calibrate the model and to improve prediction of fluid flow parameters inside the wellbore, as indicated by block 132. For example, fluid leak off to the surrounding formation can be determined more accurately through detection by the distributed sensors 100.

By way of further example, in coiled tubing drilling or wellbore clean out procedures, it is important to know the minimum fluid velocity along the coiled tubing and/or wellbore. In such operations, fluid velocity in the wellbore during normal circulation or in the coiled tubing during reverse circulation is closely related to the fluid's ability to carry sand or drilling cuttings out of the wellbore. If the fluid velocity becomes lower than a critical velocity, known as "settling velocity," efficiency of the procedure is severely reduced because the sand or cuttings cannot be efficiently circulated out of the area. With the use of sensors 52 and an accurate fluid modeling program, a well operator can be alerted when the minimal fluid velocity is close to the critical velocity. At such time, the operator can increase the operation pressure, and thus the flow rate, to avoid settling.

Figure 9:
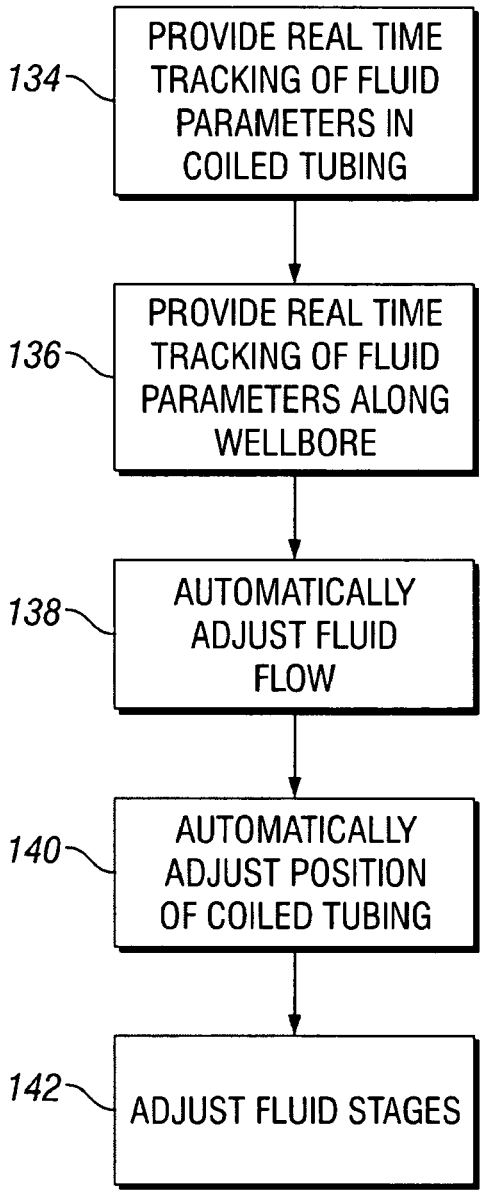
FIG. 9 is a flowchart illustrating a methodology for optimizing fluid flow, according to an embodiment of the present invention.

In the present embodiment, adjustments to the well treatment procedure based on sensor data and/or well modeling can be adjusted automatically by control system 56. Referring to FIG. 9, a flow chart is provided to illustrate the automated optimization of well treatments. As discussed above, real-time detection of well parameters, such as measuring characteristics of the fluid moving through coiled tubing 42 can be output to control system 56, as illustrated by block 134. In one embodiment, the data is output from sensors 94 disposed at a surface end 80 for construction of a suitable well simulation model on control system 56. However, sensor data from the bottom end of tubing 42 and/or from along the wellbore also can be output to control system 56, as illustrated by block 136. Based on the data transmitted from the sensors and/or the results of well simulation modeling, control system 56 can be used to determine whether aspects of the well treatment procedure are approaching critical thresholds, such as a critical velocity during coiled tubing drilling or wellbore clean out procedures.

As the critical thresholds are approached, control system 56 automatically adjusts the procedure to avoid inefficiencies in operation. If, for example, a critical minimal fluid velocity is needed to maintain operating efficiency, the automated control system 56 can be designed to automatically increase pump rate when critical velocity is approached, as illustrated in block 138. The increase in pump rate ensures that the minimal fluid velocity along the wellbore never drops below the critical fluid velocity. In other operations, e.g. a fracturing operation, the pump rate can be adjusted automatically to change the maximum fluid velocity inside the coiled tubing to ensure that it is kept below a critical erosion velocity. In other applications, the coiled tubing speed control can be adjusted automatically to ensure that a specific fluid stage exits the bottom hole assembly at the same time the bottom hole assembly reaches a target depth, as illustrated by block 140. In yet other applications, the coiled tubing speed control or surface pump control can be adjusted automatically to ensure the optimal placement of fluid, as in a uniform sweep, or placement of a predetermined stage fluid over a predetermined formation. In still other applications, the type of fluid or the amount of fluid in the fluid stages can be adjusted automatically by fluid control system 60 under the direction of overall control system 56, as illustrated by block 142. Depending on the specific well treatment application, other automated controls over the procedure can be utilized to aid in optimizing the procedure.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A method of treating an oilfield reservoir, comprising:

deploying a tubing in a wellbore that extends into a formation;

loading the tubing with a series of one or more fluid stages;

injecting a number of the series of one or more fluid stages; and detecting well related parameters to determine the need for further injection;

wherein detecting further comprises transmitting real time data regarding the well related parameters to a surface data acquisition system.

2. The method as recited in claim 1, wherein injecting comprises injecting consecutive series.

3. The method as recited in claim 1, wherein detecting comprises utilizing a distributed sensor system deployed along the wellbore.

4. The method as recited in claim 1, wherein the real time data is used in a well simulation model.

5. A method of treating an oilfield reservoir, comprising:

deploying a tubing in a wellbore that extends into a formation;

loading the tubing with a series of one or more fluid stages;

injecting a number of the series of one or more fluid stages;

detecting well related parameters to determine the need for further injection; and moving the tubing to a second formation; and injecting another number of the series of one or more fluid stages into the second formation.

6. A method of treating an oilfield reservoir, comprising:

deploying a tubing in a wellbore that extends into a formation;

loading the tubing with a series of one or more fluid stages;

injecting a number of the series of one or more fluid stages; and detecting well related parameters to determine the need for further injection;

wherein the treatment of the oilfield reservoir is optimized by altering one of a surface pump rate, a velocity of the tubing, a volume of any fluid stage, a composition of any fluid stage, and a sequence of the fluid stages.

7. A method, comprising:

stacking stages of different fluids within a tubing to create a series of fluid stages; and, injecting at least a single series into a wellbore at a specific wellbore location;

wherein consecutive series are placed within the tubing with each series having differing stage volumes relative to a preceding series.

8. The method as recited in claim 7, further comprising detecting at least one well related parameter following injecting; and using the at least one well related parameter to determine whether additional series are needed at the specific wellbore location.

9. The method as recited in claim 7, further comprising moving the tubing within the wellbore, and injecting another plurality of the series at a second specific wellbore location.

10. The method as recited in claim 8, further comprising using data gained from detecting the at least one well related parameter to provide real-time updates to a simulation model to optimize fluid flow in the wellbore and treatment of the well.

11. A method of optimizing an oilwell operation, comprising:

running coiled tubing into a wellbore;

positioning sensors to detect parameters of fluid stages injected into the wellbore through the coiled tubing;

outputting data from the sensors to a surface data acquisition system;

using the data in a well simulation model to model fluid flow down through the coiled tubing and out into the wellbore;

adjusting coiled tubing velocity based on output from the well simulation model; and changing fluid flow through the coiled tubing based on output from the well simulation model.

12. The method as recited in claim 11, further comprising positioning sensors to detect parameters of fluid stages injected into the coiled tubing at surface.

13. The method as recited in claim 12, further comprising using the real time sensor data to update the well simulation model.

14. The method as recited in claim 11, further comprising a visualization system for tracking the stage fluids that are pumped into the coiled tubing.

15. The method as recited in claim 11, wherein positioning comprises locating additional sensors proximate a lower end of the coiled tubing; and using data output from the additional sensors to provide real-time updates for optimization of a well treatment.

16. The method as recited in claim 11, wherein positioning comprises locating a distributed sensor system along the wellbore; and using data output from the distributed sensor system to provide real-time updates for optimization of a well treatment.

17. The method as recited in claim 11, further comprising using a well simulation model to track the stage fluid movement within the coiled tubing.

* * * * *